US005943724A

United States Patent [19]

Erko et al.

[11] Patent Number: 5,943,724

[45] Date of Patent: Aug. 31, 1999

[54] ELECTRO-HYDRAULIC BRUSH DOWN FORCE CONTROL

[75] Inventors: Robert Erko, Apple Valley; Daniel L. Mundt, Champlin; Terry B. Schwartz, Shoreview; Paul D. Henderson, Fridley, all of Minn.

[73] Assignee: Tennant Company, Minneapolis, Minn.

[21] Appl. No.: 09/006,747

[22] Filed: Jan. 13, 1998

[51] Int. Cl.[6] ..... A47L 11/16; A47L 11/283

[52] U.S. Cl. ..... 15/49.1; 15/50.1; 15/87; 15/98; 451/353

[58] Field of Search ..... 15/49.1, 50.1, 15/87, 98; 451/353

[56] References Cited

FOREIGN PATENT DOCUMENTS 0 173 394 3/1986 European Pat. Off. .

*Primary Examiner*—Mark Spisich

*Attorney, Agent, or Firm*—Dorn, McEachran, Jambor & Keating

[57] ABSTRACT

A floor cleaning machine of the type having a fluid driven scrub brush utilizes fluid pressure for applying down force on the scrub brush to a floor surface being cleaned. The fluid pressure applied is controlled by a fluid pressure regulator which has a movable valve element and an electrical coil for controlling the position of the movable valve element. There is a feedback circuit for controlling current through the coil which includes a source of power and a pulse width modulation switching device. The switching device in turn is controlled by a comparison between the current sensed in the coil circuit and an operator set value for the desired current to provide a desired down force on the cleaning brush.

7 Claims, 1 Drawing Sheet

ELECTRO-HYDRAULIC BRUSH DOWN FORCE CONTROL

THE FIELD OF THE INVENTION

Floor cleaning machines, both sweeping machines and scrubbing machines, may utilize electronically controlled hydraulic pressure to regulate the pressure of the cleaning brush on the floor surface. The present invention will be described particularly in connection with a scrubbing machine, although the principles disclosed are equally applicable to sweeping machines in which it is also desirable to regulate the pressure of the brush on the floor surface being cleaned. Such an electronically controlled hydraulic pressure system enables the machine operator to select a variety of scrubbing pressures and eliminates the difficult task of setting brush patterns. This system has been introduced into the field and has been found to be highly successful. However, it has one shortfall which is specifically addressed by the present application. Such machines use an open loop control system in which the machine controller essentially presents a fixed voltage to the regulator coil of the hydraulic pressure regulator. As the temperature of the coil increases, its impedance rises, changing the current flow through the coil, which changes the brush pressure on the floor. The present invention corrects for that problem by adding a feedback to the system which allows the controller to monitor and control the flow of electric current to the coil of the hydraulic regulator and thereby compensate for variations in temperature of the coil in the regulator.

U.S. Pat. No. 4,757,566 owned by Tennant Company of Minneapolis, Minn., uses a closed loop torque compensator to maintain a constant torque to the brushes on the floor. U.S. Pat. No. 4,679,271, also owned by Tennant, uses a load cell type of system of measuring the force of the brushes on the floor. The present invention specifically addresses a problem of temperature compensation in the hydraulic pressure regulator which controls down force and does not utilize a direct measurement of force applied to the floor.

SUMMARY OF THE INVENTION

The present invention relates to floor cleaning machines and more specifically to scrubbing and sweeping machines and is more particularly directed to a means for controlling the floor-directed pressure on the movable cleaning element or brush.

A primary purpose of the invention is a control system to compensate for temperature variations of the coil in the hydraulic pressure regulator which controls the down force on a movable cleaning element such as a brush.

Another purpose is to provide a simply constructed reliable down force control by regulating the current flow through the coil of the hydraulic pressure regulator which determines down force applied on the cleaning element.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to floor cleaning machines and more specifically to floor scrubbing machines, although the down pressure control system disclosed herein is equally applicable to a sweeping machine. In either type of machine there is a brush which may rotate about a vertical or horizontal axis, and in order to have a uniform cleaning job it is desired that the pressure the brush exerts on the floor being cleaned be maintained at a generally uniform set point. Typically, such systems provide for the operator to electronically select a variety of scrubbing or sweeping pressures. However, once the machine is operating, there may be variations in components of the drive system or the down pressure control system that require regulation in order to maintain uniform pressure. In the present instance the drive system for the brush and the system that provides the down pressure on the brush are hydraulic. There is a pressure regulating valve which has a movable valve member, for example a spool valve, the position of which is controlled by the amount of electrical current flowing through a coil. However, the impedance of the coil, and hence the current flowing through it, can vary with temperature. The present invention is specifically directed to compensate for any impedance variations at the coil and maintain a set current through it, and hence a constant down pressure on the floor cleaning element.

Figure 1:
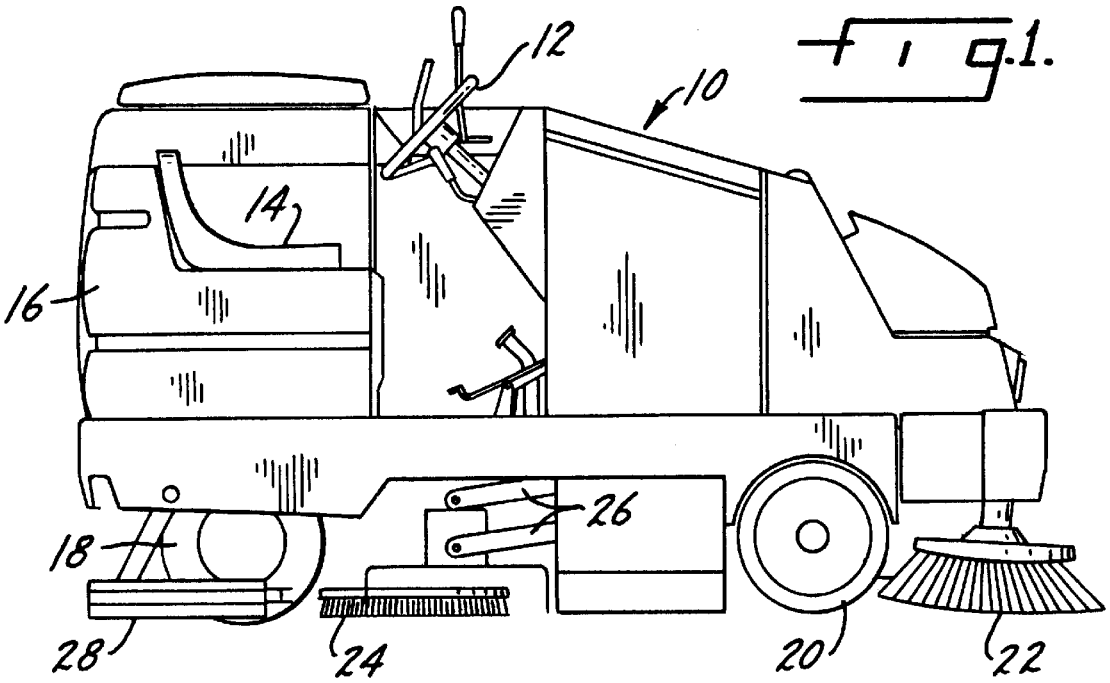
FIG. 1 is a diagrammatic illustration of a cleaning machine of the type described herein.

FIG. 1 illustrates a typical scrubbing machine of the type made by Tennant Company of Minneapolis, Minn., assignee of the present application. The machine indicated at 10 has driver controls indicated at 12, a seat for the driver shown at 14, and a body indicated generally at 16. There is a rear wheel 18 and front wheels 20 and there may be a sweeping brush 22 adjacent the front of the machine. The scrub brush is indicated at 24 and will be raised and lowered by a pair of arms indicated at 26, the movement of which is controlled by hydraulic pressure. The machine has a trailing squeegee 28, as conventional in scrubbing machines.

Figure 2:
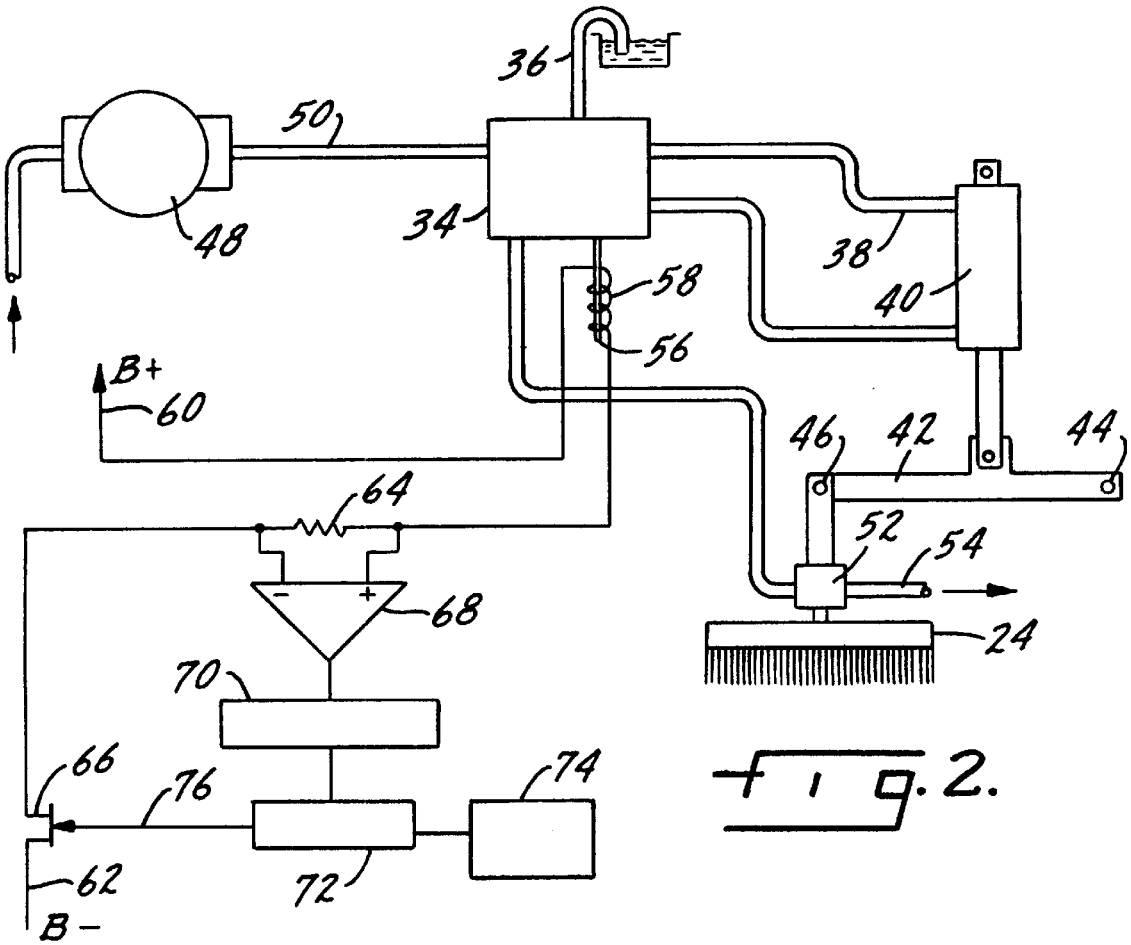
FIG. 2 is an electro-hydraulic control diagram of the fluid regulating system for applying down force on the cleaning brush.

FIG. 2 illustrates the electro-hydraulic circuit for controlling down pressure on the scrub brush. A pump 48 provides fluid through a line 50 to an electronically controlled pressure regulating valve 34. There is a conduit 36 which returns hydraulic fluid to tank and the regulated pressure from the valve 34 passes through a conduit 38 to a cylinder 40 which applies down pressure on scrub brush 24. The cylinder 40 may be pivotally attached to an arm 42, pivoted as at 44 to the machine body 16, and pivotally mounted to the brush and brush motor assembly as at 46. Thus, the down pressure on scrub brush 24 is provided by the cylinder 40 as determined by the pressure controlled by the regulator valve 34.

Pump 48, connected to the hydraulic fluid tank, provides fluid through a line 50 to the brush motor 52. There is a return line to tank for the brush motor indicated at 54. Pump 48 provides both the drive force for the brush motor, and thus the scrub brush, and the down pressure for the brush 24.

The electronically controlled regulator 34 has a spool valve therein which has a valve stem 56 extending outwardly from the regulator 34. The valve stem 56 passes through and is moved by an electric coil 58. The coil 58 is in circuit with a battery, the positive terminal being shown at 60 and the negative terminal at 62. Also in circuit between the battery terminals and coil 58 is a sensing resistor 64 and a pulse width modulation switching device 66. Current flowing through the circuit for coil 58 will pass through resistor 64 and provide a voltage drop across this resistor. A differential amplifier 68 is connected across resistor 64 and thus will provide an analog indication of the voltage drop across the resistor, which voltage drop is directly reflective of the current flowing through coil 58.

The output of differential amplifier 68 is connected to an analog to digital converter 70 which in turn is connected to a central processing unit 72. The operator set value for the down pressure provides a digital reference related to current for the CPU 72 and this is indicated at 74 in the electrohydraulic diagram of FIG. 2. The CPU 72 will thus compare the desired current which is reflective of the desired down pressure, with the actual current as measured by resistor 64 and as converted to digital form by the A-D converter 70. The result of the comparison in the CPU will be an output along line 76 to the pulse width modulating switching device 66. The result of the signal from the CPU will be a variation in the pulse width of the current flowing through the above-described circuit from the battery to the coil 58. The pulse width modulation provided by switching device 66 will compensate for variations in temperature of the coil so as to maintain the current flowing through the coil at a desired level consistent with the operator's predetermined down pressure for the scrub brush. The operator may not set a current level, but will set a desired down pressure and this will be reflected in the desired current provided by reference 74 to the CPU 72.

The principal concern in maintaining constant down pressure in an electrohydraulic system of the type described is the variation in temperature within the coil 58. The coil normally heats up after a period of use and this produces a change in impedance which, if not compensated for, would change the current flowing through the coil. This would vary the force on valve stem 56, which would result in an incorrect down pressure on the scrub brush. The circuit described provides for maintaining down pressure at the operator set point and this is accomplished by means of regulating the current through the coil of the electronically controlled fluid pressure regulator 34.

Whereas the preferred form of the invention has been shown and described herein, it should be realized that there may be many modifications, substitutions and alterations thereto.

The embodiments of the invention in which an exclusive property or privilege is claimed are defined as follows:

1. A floor cleaning machine having a movable cleaning element and means for driving said cleaning element, means for applying a floor-directed fluid pressure on said movable cleaning element during use thereof, including a fluid pressure regulator, said regulator including a movable valve element and an electrical coil for controlling the position of said movable valve element, a feedback circuit for controlling current through said coil including a source of power connected to said coil, means for sensing current flow in said circuit through said coil, means for comparing sensed current with an established desired current, and means for varying current applied to said coil in accordance with the comparison between actual sensed current and said established current to maintain current flow through said coil at a desired level to maintain a desired floor-directed fluid pressure on said movable cleaning element.

2. The floor cleaning machine of claim 1 wherein the means for varying current applied to said coil include switch means responding to the comparison between actual sensed current and the established desired current for providing pulse width modulation of current flow in said circuit.

3. The floor cleaning machine of claim 2 wherein said switch means is opened and closed in accordance with the comparison between actual sensed current and the established desired current.

4. The floor cleaning machine of claim 1 wherein the means for sensing current flow in said circuit includes a resistance in said circuit, a differential amplifier connected across said resistance, with the output of said differential amplifier being connected to a central processing unit which compares sensed current with the established desired current.

5. The floor cleaning machine of claim 4 wherein said feedback circuit further includes an analog to digital converter connected between said differential amplifier and said central processing unit.

6. The floor cleaning machine of claim 1 wherein said movable cleaning element is a rotatable scrub brush.

7. The floor cleaning machine of claim 6 wherein said rotatable scrub brush is fluid driven.

* * * * *